US005673546A

United States Patent [19]

Abraham et al.

[11] Patent Number: 5,673,546

[45] Date of Patent: Oct. 7, 1997

[54] NON-SLIP SHOELACES

[76] Inventors: Carl J. Abraham, 3 Baker Hill Rd., Great Neck, N.Y. 11023; Kimti Lal Gandhi, 6 Greenleaf Close, Boothstown, Worsley Manchester, England, M28 4HW

[21] Appl. No.: 578,019

[22] Filed: Dec. 26, 1995

[51] Int. Cl.[6] ..... D02G 3/02; D02G 3/36

[52] U.S. Cl. ..... 57/206; 24/713; 87/3; 87/11; 87/12

[58] Field of Search ..... 57/206, 207, 208, 57/209; 87/8, 9, 6, 11, 12, 3, 13; 24/713

[56] References Cited

U.S. PATENT DOCUMENTS

| | | | |
|---|---|---|---|
| 1,997,771 | 4/1935 | McGowan | 57/209 |
| 2,141,801 | 12/1938 | Taft | 24/713 |
| 2,306,515 | 12/1942 | Wright . | |
| 2,477,151 | 7/1949 | Stapleton | 24/713 |
| 2,639,481 | 5/1953 | Lester . | |
| 3,059,518 | 10/1962 | Nelson | 87/8 |
| 3,110,945 | 11/1963 | Howe . | |
| 3,136,111 | 6/1964 | Pittman | 57/208 |
| 3,518,730 | 7/1970 | Cupler . | |
| 4,247,967 | 2/1981 | Swinton | 24/143 R |
| 4,754,685 | 7/1988 | Kite et al. | 87/9 |
| 5,074,031 | 12/1991 | Werner | 29/747 |
| 5,272,796 | 12/1993 | Nichols | 24/713 |

*Primary Examiner*—William Stryjewski
*Attorney, Agent, or Firm*—Levine & Mandelbaum

[57] ABSTRACT

A slip resistant shoe lace is produced by weaving or braiding a plurality of standard yarns with special yarns. The special yarns have a special effect in the form of slubs or eccentricities at regular intervals or throughout the length of the yarn and when woven or braided along with the standard yarns produce protuberances along the length of the shoe lace for resisting untying of the lace.

18 Claims, 2 Drawing Sheets

NON-SLIP SHOELACES

BACKGROUND OF THE INVENTION

This invention relates to shoelaces. More specifically, the invention is directed to shoelaces which resist loosening after they are tied.

Untying of shoe laces is a common problem and practically everyone in his or her life experiences occurrence of shoe laces become untied which can be annoying if not embarrassing or even dangerous. A number of factors can cause untying of the bow-knot in a shoelace, including cyclic fatigue, stress and strain, compression and expansion of the shoelace portion forming the bow-knot and/or a length of the lace which passes through the eyelets of the shoe, the type of bow-knot, type of fiber used in the shoelace yarn, and the method of forming of the lace.

Proposed solutions in the prior art use virtually the same principle to eliminate or reduce untying of a bow-knot in a lace. This principal involves the formation of a number of protuberances longitudinally spaced, either along the entire length of the lace, or a segment on each end of the lace intended for use in forming the bow-knot. These protuberances are to help retain the bow-knot, and segments of the laces passing through the eyelets of the shoe, in position and to resist untying of the laces. However, the results of prior art approaches to eliminating or reducing untying of laces have not been satisfactory nor have they been achieved economically.

In some methods known in the prior art protuberances are formed on shoelaces after the laces have been manufactured by weaving, including tubular weaving, braiding, or knitting. The prior art has also suggested that various types of protuberances be incorporated into the shoe lace.

U.S. Pat. No. 2,639,481 describes a shoe lace having protuberances formed by sewing a length of special thread repeatedly through the lace after the original process of producing the laces has been completed. U.S. Pat. No. 2,477,151 discloses a shoe lace having a strand of round section woven back and forth at spaced intervals through the lace along its length to form protuberances after the original lace has been produced.

In U.S. Pat. No. 2,306,515 a different approach has been taken to form protuberances by using metal staples of different shapes along a segment at each end of the lace. The metal staples are inserted in the lace after the lace has been produced. U.S. Pat. No. 5,272,796 covers the manufacture of a shoe lace by weaving or braiding strands having a conventional coefficient of friction with at least one strand having a higher coefficient of friction. The higher friction strand is made in a separate process by impregnating a conventional strand with friction enhancing substances. The impregnated strand is then introduced into the lace at the time of manufacture by a weaving or braiding process.

U.S. Pat. Nos. 4,247,967 and 5,074,031 describe the production of a slip resistant shoelace using Velcro. In U.S. Pat. No. 4,247,967, a slip resistant binding is formed by attaching male and female Velcro strips or other binding material along opposite ends of a shoe lace. In U.S. Pat. No. 5,074,031, the lace is provided only with hook-type Velcro. The patent relies on the natural loop structure of woven or braided fabric to provide the loops with which the hook-type Velcro co-operates.

U.S. Pat. No. 3,110,945 refers to production of a slip resistant lace by providing, in combination with a standard tipped tubular weave shoe lace, a plurality of spaced protuberances in the form of knots tied at preselected intervals along the length of the lace. U.S. Pat. No. 3,518,730 employs an approach wherein protuberances are not formed by introducing any special strand or other material. Instead, the shoelace has a thin central core, formed from one to ten parallel strands that are surrounded by oppositely wound strands having less linear extensibility then the core strands. The result is a roughened surface on the lace which resists untying.

The methods disclosed in the prior art generally involve making slip-resistant shoelaces in a two stage process, the second step of which includes the formation of protuberances.

SUMMARY OF THE INVENTION

The aforementioned problems of the prior art are overcome by the instant invention which provides for a shoe lace which can be produced by braiding or weaving, including tubular weaving, using special yarns with special features of different shapes, distributed continuously or at regular intervals along the length of the yarn, the special yarns having specified linear densities and coefficients of friction. The special yarns are used in conjunction with standard yarns of compatible linear density, material, and coefficient of friction. The special yarns when interlaced with standard yarns in specified proportion produce a lace with a plurality of protuberances. These protuberances are formed economically at the same time as the lace is produced.

It is therefore an object of the invention to provide a non-slip shoelace which can withstand cyclic fatigue, stress and strains encountered during normal use.

Another object of the invention is to provide a shoelace which can be manufactured economically in a single process by weaving braiding, knitting or other interlacing methods.

Still another object of the invention is to provide a shoelace in which a properly tied bow-knot does not untie during its use.

Still a further object of the invention is to provide a shoelace which resists slipping through the eyelets of a shoe into which it is threaded.

Other and further objects of the invention will be apparent from the following drawings and description of a preferred embodiment of the invention in which like reference numerals are used to indicate like parts in the various views.

DESCRIPTION OF THE PREFERRED EMBODIMENT

Figure 1:
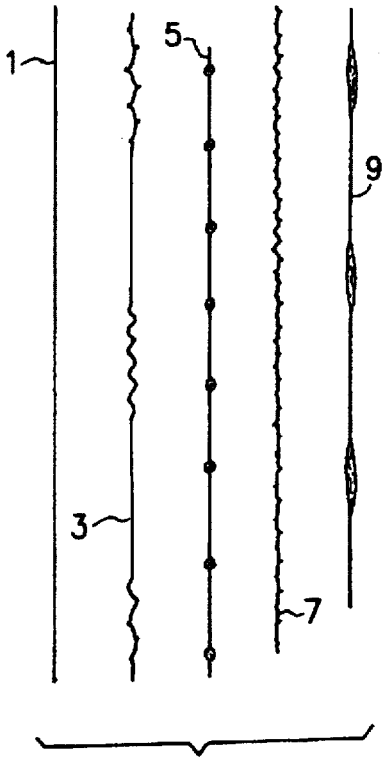
FIG. 1 is a plan view of a yarns suitable for use in accordance with a first preferred embodiment of the invention.

Referring now to FIG. 1, there are shown five types of yarns 1, 3, 5, 7, and 9, combinations of which may be combined together to form a non-slip shoe lace. Yarn 1 is a standard, i.e., linear yarn having the required linear density for the shoelace sought to be fabricated. Yarns 3, 5, 7 and 9 are each specialized yarns which, unlike yarn 1, have longitudinally varying densities. For example, yarn 3 has alternating, evenly spaced, straight and twisted or eccentric segments. When the special laces are woven into the lace, these eccentricities resist slippage and untying. Yarn 5 is provided with spherical slubs evenly spaced along its length. Yarn 7 has eccentricities along its entire length like the eccentricities of yarn 3 and without the intermediate linear segments of yarn 3. Yarn 9 has ovoid slubs evenly spaced along its length. A non-slip shoe lace can be fabricated by combining multiple strands of the yarn 1 of uniform linear density with one or more of the special yarns 3, 5, 7, and 9. When two lengths of such a lace are tied, the sections in the laces with and without protuberances interlock or engage between them in such a manner that any tendency on the part of the bow-knot to slop is reduced.

Figure 2A:
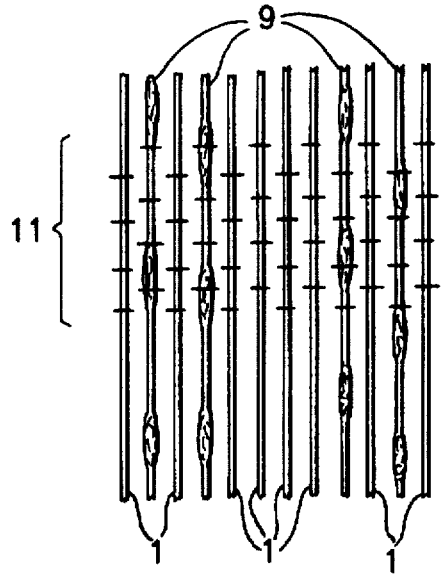
FIG. 2*a* is a flattened view of a non-slip shoelace in accordance with the first preferred embodiment of the invention.
Figure 2B:
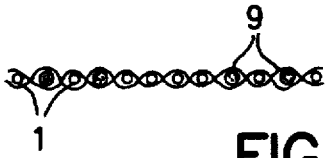
FIG. 2*b* is an end view of the non-slip shoelace of FIG. 2*a*.

A shoelace in accordance with a first preferred embodiment of the invention will now be described with reference to FIGS. 2*a* and 2*b*. Referring now to FIG. 2*a* there is shown a slip resistant lace made up of standard warp yarns 1 and special yarns 9 of required linear density in the warp direction. The yarns 1 and 9 can be made from any conventional natural or synthetic fiber material, such as cotton, polyester, nylon, or polypropylene or any of the foregoing blended with other fibers. The ratio of the number of standard yarns to the number of special yarns, the linear densities of the yarns and their relative positions in the fabricated shoelace can be chosen in accordance with the quality of the lace required for the shoe for which it is intended. For example, the ratio of the number of standard yarns to the number of special yarns can be in the range of from 3–5 to 1. The linear densities of the standard yarns 1 can be 50 rex, R 20 tex/2 to R 59 tex/2 and the linear densities of the special yarns can be 200–400 tex.

The warp yarns 1 and 9 are interlaced by weft yarns 11 of desired coefficient of friction compared to warp yarns. For example, the coefficients of friction can be 0.20 to 0.60 for the standard yarns, 0.20 to 0.50 for the special yarns, and 0.20 to 0.40 for the weft yarns.

The weft density i.e. number of picks per centimeter, is decided according to the lace quality required and the weft yarn can either be of a special structure, e.g., similar to yarns 3, 5, 7 or 9, or just a standard structure, similar to yarn 1. For example, the weft density may be in the range of from 15 to 25 picks per centimeter.

Figure 3A:
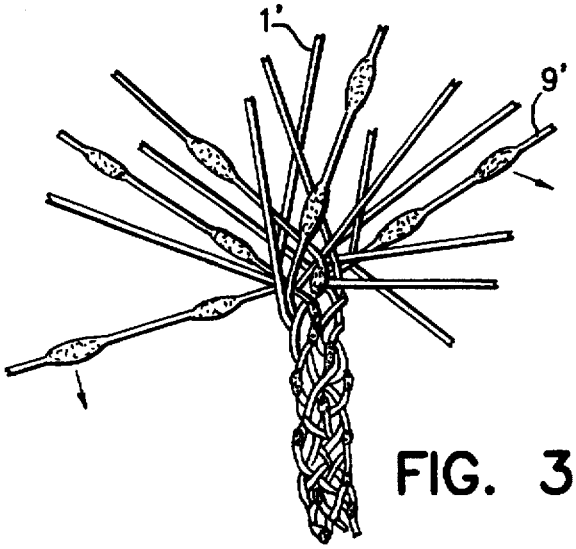
FIG. 3*a* is a perspective view of a hollow non-slip shoelace during a stage of fabrication in accordance with a second preferred embodiment of the invention.
Figure 3B:
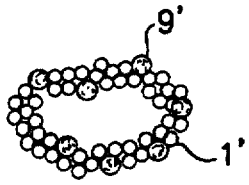
FIG. 3*b* is a cross sectional view of the hollow non-slip shoelace of FIG. 3*a*.

A shoelace in accordance with a second preferred embodiment of the invention will now be described with reference to FIGS. 3*a* and 3*b*. FIGS. 3*a* and 3*b* show a hollow shoe lace made up of yarns which are braided. Two or more strands of a special yarn 9' having ovoid slubs are braided with standard yarns 1' having either the same coefficient of friction as the special yarns 9' or a lower coefficient of friction.

The ratio of the number of standard yarns to the number of special yarns, the linear densities of the yarns and their relative positions in the fabricated shoelace can be chosen in accordance with the quality of the lace required for the shoe for which it is intended. For example, the ratio of the number of standard yarns to the number of special yarns in the embodiment illustrated in FIGS. 3*a* and 3*b* can be in the range of from 4–6 to 1. The linear densities of the standard yarns 1 can be 50 rex, R 20 tex/2 to R59 tex/2 and the linear densities of the special yarns can be 200 to 400 tex.

Figure 4A:
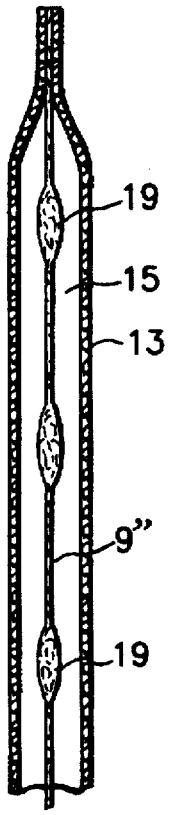
FIG. 4*a* is a sectional view of a third preferred embodiment of the invention.
Figure 4B:
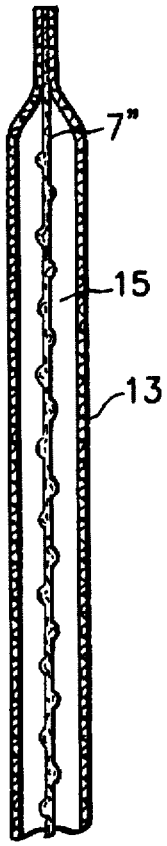
FIG. 4*b* is a sectional view of a variation of the embodiment of the invention shown in FIG. 4*a*.

Referring now to FIGS. 4*a* and 4*b*, there is shown a slip resistant shoe lace produced by a method utilizing the principle of tubular weaving. A standard tubular weaving structure is used to form a standard lace having an outer wall 13 made up of standard yarns and a hollow or cavity portion 15. Into the cavity there are introduced special strands, i.e., yarns 9" of required linear density. The special yarns 9" can have ovoid slubs 19 as shown in FIG. 4*a*. Alternatively, the lace can be formed from special yarns 7" with eccentricities, e.g., the special yarn 7 described with reference to FIG. 1. As in the case of the previously described embodiments of the invention, here too, the ratio of the number of standard yarns to the number of special yarns, the linear densities of the yarns and their relative positions in the fabricated shoelace can be chosen in accordance with the quality of the lace required for the shoe for which it is intended. For example, the ratio of the number of standard yarns to the number of special yarns can be in the range of from 6–8 to 1. The linear densities of the standard yarns 1 can be 50 tex, R 20 tex/2 to R 59 tex/2 and the linear densities of the special yarns can be 200 to 400 tex.

Figure 5:
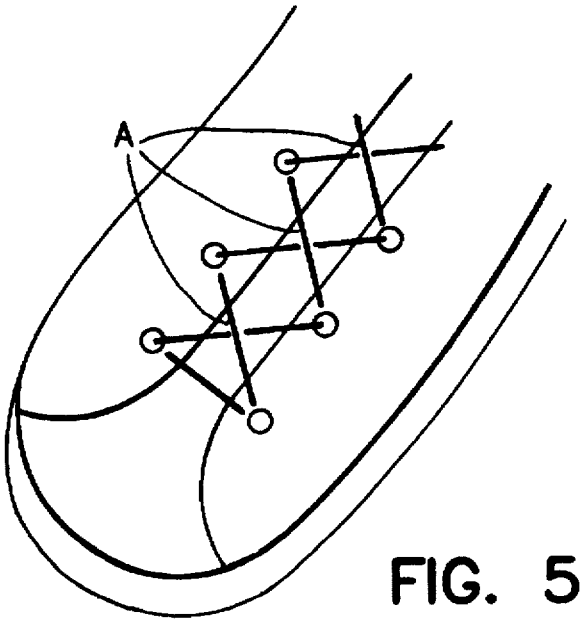
FIG. 5 is a perspective view of a preferred embodiment of the invention in its intended environment.

In use the lace constructed in accordance is threaded through the eyelets of a shoe as shown in FIG. 5. After the shoe is place on the foot of the wearer, the ends of the lace are tied in a bow-knot. The protuberances along the lace engage one another in the bow-knot to resist untying and engage the inner edges of the eyelets in the shoe to resist slippage of the lace through the eyelets.

This also happens at the crossing points A on the length of the laces where they cross while passing through the different eyelet of the shoe as shown in FIG. 5. The net effect is that the occurrence of the untying of the laces is essentially eliminated.

It is to be appreciated that the foregoing is a description of three preferred embodiments of the invention to which variations and modifications may be made without departing from the spirit and scope of the invention.

What is claimed is:

1. A shoe lace for threading through eyelets of a shoe and tying with a bow-knot to secure the shoe comprising a plurality of strands of at least one standard yarn having a substantially non-varying cross section along its length and at least one special yarn having enlarged regions resulting in a cross section variable along its length, said standard yarn and said special yarn being interlaced whereby the enlarged regions form protuberances distributed over an outer surface of the lace for resisting untying of a bow-knot made with the lace and slippage of the lace through the eyelets.

2. A shoe lace according to claim 1 wherein said yarns are knitted together.

3. A shoe lace according to claim 1 wherein said yarns are braided together.

4. A shoe lace according to claim 1 wherein said yarns are woven together.

5. A shoe lace according to claim 4 wherein said yarns are woven together in a tubular weaving process.

6. A shoe lace according to claim 1 further comprising a plurality of weft yarns, a plurality of standard yarns, and a plurality of special yarns, said weft yarns being woven among said standard yarns and said special yarns.

7. A shoe lace according to claim 6 wherein the weft yarns have a coefficient of friction in the range of from 0.2 to 0.4.

8. A shoe lace according to claim 7 wherein the linear density of the special yarn is in the range 200–400 tex.

9. A shoe lace according to claim 6 wherein the standard yarns have a coefficient of friction in the range of from 0.2 to 0.6.

10. A shoe lace according to claim 6 wherein the special yarns have a coefficient of friction in the range of from 0.2 to 0.5 between the protuberances.

11. A shoe lace according to claim 1 wherein the ratio of the number of standard yarns to the number of special yarns is in the range of from 3–5 to 1.

12. A shoe lace according to claim 1 wherein the linear density of the standard yarn is in the range of R 20 tex/2 to R 59 tex/2.

13. A shoe lace according to claim 1 wherein the protuberances are evenly spaced along substantially the entire length of the lace.

14. A shoe lace according to claim 1 wherein the protuberances are spherical.

15. A shoe lace according to claim 1 wherein the protuberances are ovoid.

16. A shoe lace according to claim 1 wherein the protuberances are formed by eccentricities in the special yarn.

17. A shoe lace according to claim 16 wherein the eccentricities run continuously along substantially the entire length of the special yarn.

18. A shoe lace according to claim 16 wherein the eccentricities run in spaced segments distributed along the length of the special yarn.

* * * * *